US007535443B2

(12) United States Patent
Lindqvist

(10) Patent No.: US 7,535,443 B2
(45) Date of Patent: May 19, 2009

(54) APPARATUS AND METHOD FOR PRODUCING VARIABLE INTENSITY OF LIGHT

(75) Inventor: Timo T. Lindqvist, Teijo (FI)

(73) Assignee: Nokia Corporation, Espoo (FI)

( * ) Notice: Subject to any disclaimer, the term of this patent is extended or adjusted under 35 U.S.C. 154(b) by 679 days.

(21) Appl. No.: 10/745,467

(22) Filed: Dec. 22, 2003

(65) Prior Publication Data

US 2005/0134188 A1 Jun. 23, 2005

(51) Int. Cl.
*G09G 3/32* (2006.01)

(52) U.S. Cl. ..... 345/82; 345/77

(58) Field of Classification Search ..... 345/76, 345/77, 82, 83; 315/149, 194; 700/12
See application file for complete search history.

(56) References Cited

U.S. PATENT DOCUMENTS 5,365,148 A * 11/1994 Mallon et al. ..... 315/194
5,422,544 A 6/1995 Giddings et al.
5,455,487 A 10/1995 Mix et al.
5,854,542 A 12/1998 Forbes
6,016,038 A 1/2000 Mueller et al.
6,388,388 B1 5/2002 Weindorf et al.
6,488,390 B1 12/2002 Lebens et al.
2002/0113555 A1 8/2002 Lys et al.
2003/0043611 A1 3/2003 Bockle et al.
2006/0203136 A1 * 9/2006 Testin et al. ..... 348/836

FOREIGN PATENT DOCUMENTS

DE 19711885 9/1998
DE 19814745 10/1999

OTHER PUBLICATIONS

"Temporal Sensitivity", Chapter 6, Andrew B. Watson, NASA Ames Research Center, Moffett Field, California, pp. 6-1 through 6-43.
European Office Action dated Apr. 27, 2007 issued in European Patent Application No. 04805183.3 (7 pages).

* cited by examiner

*Primary Examiner*—Ricardo L Osorio

(57) ABSTRACT

A lighting control arrangement controls the user interface lighting in a portable electronic device. An output of the lighting control arrangement selectively provides lighting intensity commands to a lighting controller. Each of the lighting intensity commands indicates one of certain basic lighting intensity levels. A level selector repeatedly changes, at a frequency that is higher than an integration frequency of a human visual system, the lighting intensity command to be provided at said output.

37 Claims, 7 Drawing Sheets

APPARATUS AND METHOD FOR PRODUCING VARIABLE INTENSITY OF LIGHT

TECHNICAL FIELD

The invention concerns generally the technical field of varying the intensity of light emitted by a light source. Especially the invention concerns the problem of obtaining a large selection of different light intensities from a light source with a simple controlling arrangement.

BACKGROUND OF THE INVENTION

In a large variety of applications it is desirable to be able to control the intensity of light emitted by an electrically driven light source. The present invention concerns especially the user interfaces of portable electronic apparatuses, where artificial illumination is used to enhance the usability of the user interface when ambient light is not enough, and to increase visual attractiveness. Typical illuminated user interface components include but are not limited to displays and keypads. Light sources are typically either discharge tubes or LEDs (Light Emitting Diodes).

FIG. 1 illustrates a known principle of providing controllable illumination to a user interface. A light source 101 is coupled between the output of a lighting controller 102 and ground. The light source 101 conceptually represents any arrangement of one or several physical light-emitting devices. The lighting controller receives a constant operational voltage Vcc from a voltage source 103, and lighting control commands from a microprocessor 104. A sensor 105 is coupled to an input of the microprocessor 104. The task of the sensor 105 is to detect the need for user interface illumination. It provides a measurement result to the microprocessor 104, which translates the measurement result into a lighting control command and outputs it to the lighting controller 102. The lighting controller 102 controls the voltage and/or current going to the light source 101. The sensor 105 may be e.g. a phototransistor that measures the amount of ambient light. Alternatively the sensor 105 may exist only "conceptually" in a software routine executed by the microprocessor 104: the software routine may e.g. dictate that the occurrence of an incoming call must be responded to by changing the illumination of the user interface in a certain way.

The most basic form of illumination control involves only setting lights on or off according to need. More sophisticated lighting control arrangements are capable of providing several levels of illumination intensities. FIG. 2 illustrates schematically two known ways of obtaining different illumination intensities with LED sources. The topmost graph 201 represents the principle of varying the electric current fed into the LED(s). The middle graph 202 illustrates the principle of pulse width modulation (PWM), in which the current fed into the LED(s) is repeatedly switched between zero and a constant non-zero value. The duty cycle, i.e. the length in time of the ON pulse compared to the combined length of consecutive ON and OFF periods, is varied according to the desired light intensity. In the drawing the duty cycle is first 80%, then 40%, then 20% and finally 60%. Graph 203 at the bottom shows how both of the above-mentioned methods result in a varying intensity of light emitted by the LED(s).

Known prior art publications that tackle the problem of providing variable output intensities include DE 19 71 1885, DE 19 81 4745 and U.S. 2003/043611 A1. Of these, the last-mentioned presents an interesting embodiment in which the duty cycle of a PWM controller is kept essentially constant at 50%, but the switching frequency is varied in relatively wide limits like between 200 kHz and 1 MHz. In addition to a light source there is a resonant element coupled to the output of the PWM controller. The resonance characteristics of the combined output circuit cause the light source to emit light at a highest intensity level when the switching frequency coincides with the resonance frequency of the output circuit. The farther the switching frequency goes from the resonance frequency, the lower is the intensity of emitted light.

The drawbacks of the prior art arrangements become apparent when a question is raised about the number of different intensity levels that can be obtained. Even if the theoretical principle of current control or pulse width modulation could enable even a stepless control between zero and a maximum value, practical current controllers and PWM controllers that are available for integration with other electronic functionalities of a portable electronic device usually have a relatively modest number of possible output modes. A typical integrated PWM controller circuit includes three or four control switches or single-bit control input lines, the states of which affect the duty cycle (or the switching frequency in the case of U.S. 2003/043611 A1). Consequently there are only 8 or 16 possible intensity levels of emitted light. These may well be enough for providing a number of steady-state conditions to choose from, but they are certainly not sufficient to implement changes of intensity that a human user should perceive as stepless dimming or brightening.

SUMMARY OF THE INVENTION

It is an objective of the present invention to provide an apparatus and a method for producing a variable intensity of light emitted at the user interface of a portable electronic device. A specific objective of the present invention is to enable controlling the intensity of emitted light at very small steps. A further objective of the invention is to ensure the applicability of the method and apparatus according to the invention in mobile communication devices.

The objectives of the invention are achieved by utilizing at least two alternative output modes of a lighting controller in a time multiplexed manner, so that the final result perceived by a human user depends on the natural integration over time performed by the human visual system.

A lighting control arrangement according to an aspect of the invention comprises:

- an output configured to selectively provide lighting intensity commands to a lighting controller, each of which lighting intensity commands indicates one of certain basic lighting intensity levels and
- a level selector configured to repeatedly change, at a frequency that is higher than an integration frequency of a human visual system, the lighting intensity command to be provided at said output.

A lighting control system according to an aspect of the invention comprises:

- a lighting controller coupled to receive lighting intensity commands from a lighting control arrangement and to provide a lighting intensity signal to a light source, said lighting controller being configured to respond to each of a number of lighting intensity commands by producing a lighting intensity signal that corresponds to one of certain basic lighting intensity levels,
- a lighting control arrangement having an output coupled to said lighting controller, and
- as a part of said lighting control arrangement a level selector configured to repeatedly change, at a frequency that is higher than an integration frequency of a human visual system, the lighting intensity command to be provided at said output.

A portable electronic device according to an aspect of the invention comprises:

a user interface, at least one controllable light source configured to provide controlled lighting to said user interface, a lighting controller coupled to receive lighting intensity commands from a lighting control arrangement and to provide a lighting intensity signal to said at least one controllable light source, said lighting controller being configured to respond to each of a number of lighting intensity commands by producing a lighting intensity signal that corresponds to one of certain basic lighting intensity levels, a lighting control arrangement having an output coupled to said lighting controller, and as a part of said lighting control arrangement a level selector configured to repeatedly change, at a frequency that is higher than an integration frequency of a human visual system, the lighting intensity command to be provided at said output.

A method for controlling user interface lighting according to an aspect of the invention comprises the steps of:

producing a sequence of lighting intensity commands, each of which is a command for a lighting controller to produce one of certain basic lighting intensity levels and providing said lighting intensity commands to a lighting controller at a frequency that is higher than an integration frequency of a human visual system.

A computer program product for controlling user interface lighting according to an aspect of the invention comprises:

computer program means configured to make a programmable electronic circuit to produce a sequence of lighting intensity commands, each of which is a command for a lighting controller to produce one of certain basic lighting intensity levels and computer program means configured to make a programmable electronic device to provide said lighting intensity commands to a lighting controller at a frequency that is higher than an integration frequency of a human visual system.

The human visual system performs temporal integration with a time constant that has been said to vary according to the mean intensity involved in the changes of imaged data. According to an article "Temporal sensitivity" by A. B. Watson, published in Handbook of Perception and Human Perfomance, K. R. Bof, L. Kaufman, and J. P. Thomas, Eds. New York: Wiley, 1986, ch. 6, at low mean intensity levels the naturally occurring integration period may exceed 100 ms, while at high mean intensity levels it appears to be of the order of 10 ms. Said integration periods correspond to integration frequencies of 10 Hz and 100 Hz respectively. This integration characteristic creates a certain smoothing effect, so that if repeated changes occur in the actual observed visual signal at a frequency that is higher than the integration frequency, a human observer only perceives a certain mean or effective value of the visual signal.

During the research work that led to the present invention it was found that the naturally occurring integration characteristic of the human visual system can be utilized so that a number of desired, tightly spaced lighting intensity levels are actually the result of fast temporal multiplexing of certain more coarsely spaced basic intensity levels. In other words, when certain basic levels of lighting intensity levels have been defined, it is possible to repeatedly switch between these levels at a frequency that is much higher than the integration frequency of the human visual system. The relative amounts of using each basic or "component" intensity level in the switching cycle determines, what will be the eventual mean intensity perceived by a human user. If the switching frequency is high enough, it is possible to control the relative amounts of the basic intensity levels in very small steps. This way even essentially stepless dimming and brightening become possible.

The basic idea of the invention can be implemented in practice in many ways. For defining the basic or component intensity levels it is most straightforward to utilize a lighting controller resembling the known prior art examples, which when connected to feed a light source is capable of producing at least two different basic lighting levels. The lighting controller may be for example a current controller or a PWM controller, and it must be capable of switching between basic lighting levels in a relatively fast way. In order to produce the temporal multiplexing of basic lighting levels, a piece of controlling hardware or a controlling software routine is used. It issues commands to the basic lighting controller to repeatedly switch between basic lighting levels according to a switching scheme that depends on the desired level of mean intensity of emitted light.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION

The exemplary embodiments of the invention presented in this patent application are not to be interpreted to pose limitations to the applicability of the appended claims. The verb "to comprise" is used in this patent application as an open limitation that does not exclude the existence of also unrecited features. The features recited in depending claims are mutually freely combinable unless otherwise explicitly stated.

Figure 1:
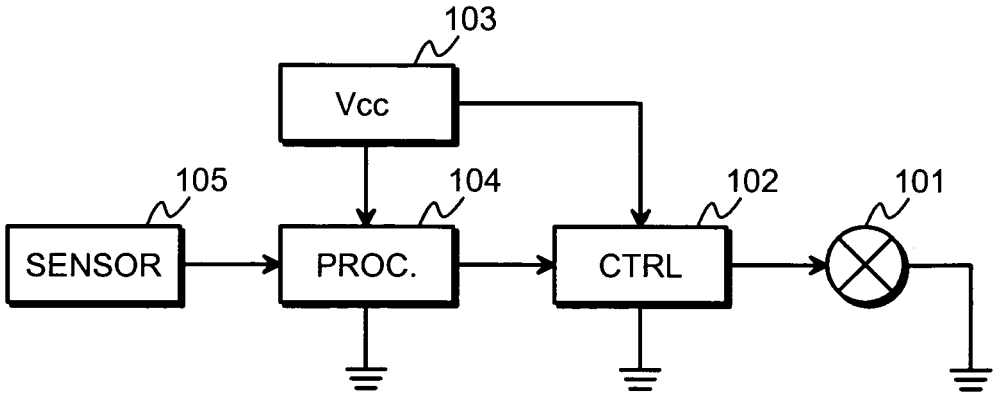
Fig. 1 PRIOR ART
FIG. 1 illustrates a prior art lighting control principle.
Figure 2:
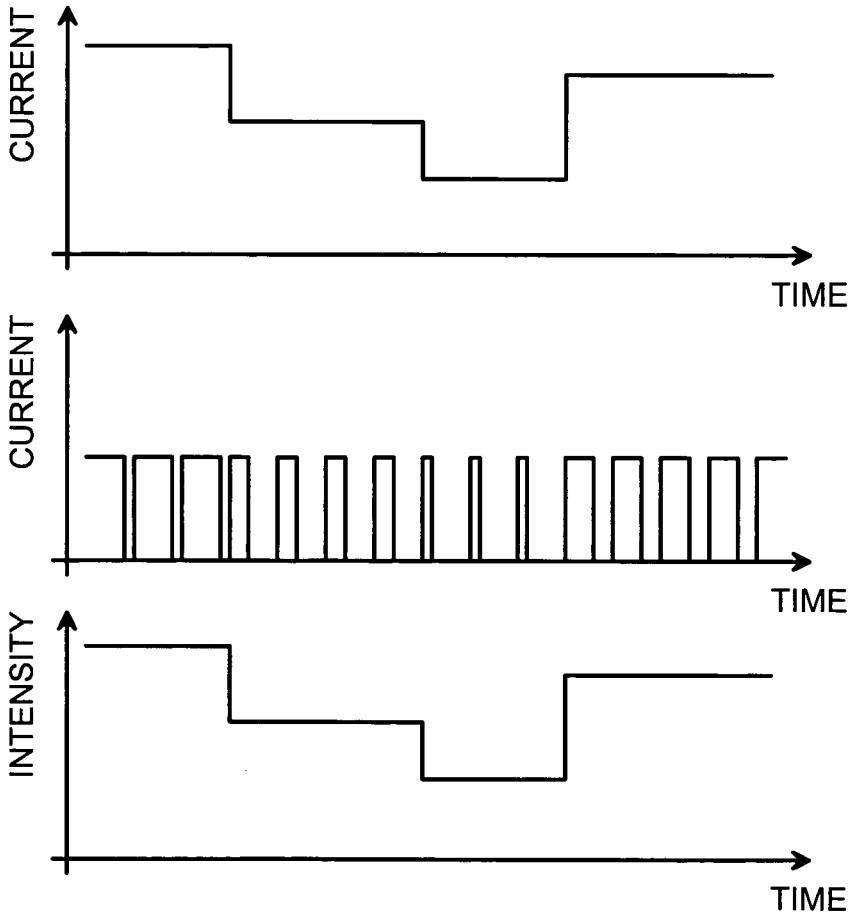
Fig. 2 PRIOR ART
FIG. 2 illustrates the principles of current and PWM control.
Figure 3:
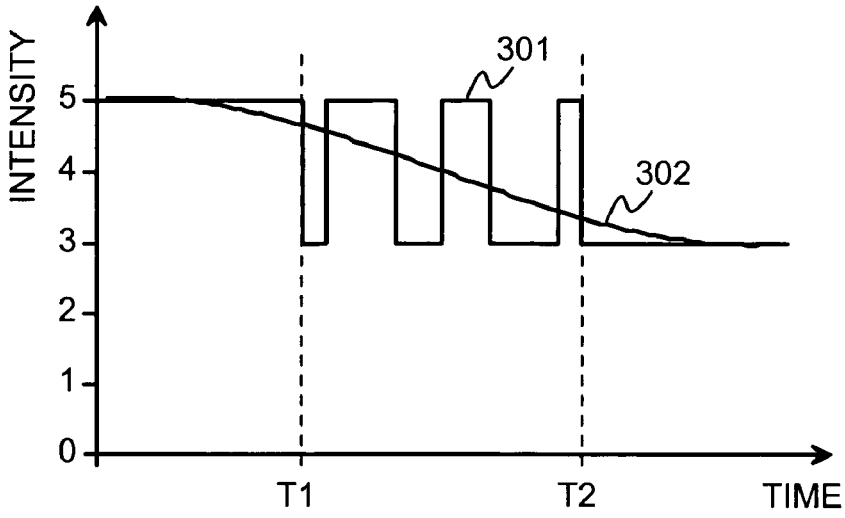
FIG. 3 illustrates an exemplary switching sequence.

FIG. 3 illustrates a principle of using variable temporal multiplexing and integration to obtain a smooth change between two intensity levels. The horizontal axis represents time, and the vertical axis represents lighting intensity in some arbitrary units. We may assume that a combination of a basic lighting controller and a light source connected thereto is able to produce an intensity of 5 units or an intensity of 3 units. At the beginning of the process the output intensity is constant at 5 units. At time T1 there is started a switching sequence during which the basic lighting controller is repeatedly switched between two states, the first of which corresponds to the basic or component intensity level of 5 units while a second state corresponds to the basic or component intensity level of 3 units. The switching sequence involves first going from the first state over to the second state only for a very short time instant and then repeatedly decreasing the relative dwelling time in the first state and correspondingly increasing the relative dwelling time in the second state, so that eventually after time T2 the basic lighting controller stays constantly in the second state.

Assuming that the light source is a LED or some other non-incandescent light source the internal characteristics of which do not cause any significant delay in changes of emitted intensity, the stepped curve 301 illustrates the actual level of light intensity over time. However, temporally integrating detection means such as the human visual system may be slow enough not to notice all fast changes between intensity levels. The rounded curve 302 illustrates how the change is perceived through such temporally integrating detection means.

Figure 4:
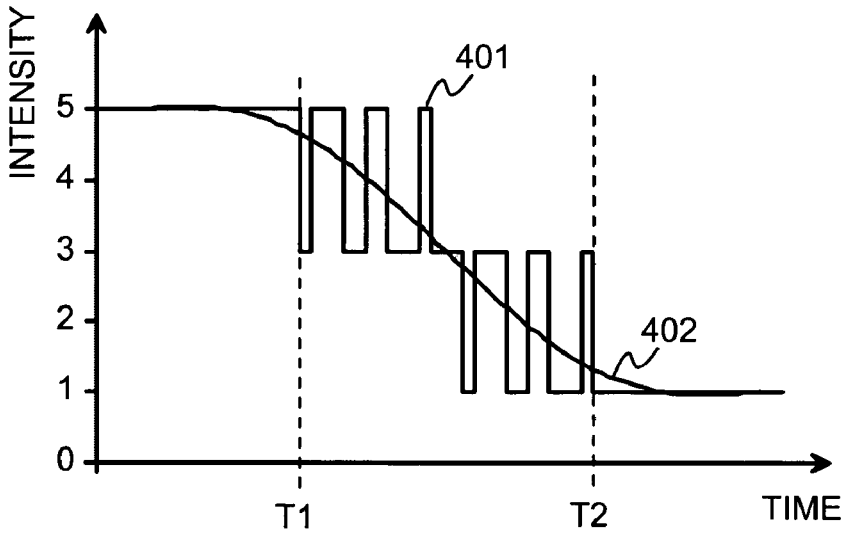
FIG. 4 illustrates another exemplary switching sequence.

FIG. 4 illustrates a similar gradual change between two basic intensity levels, which in this example are located at 5 units and 1 unit. Additionally there is another basic or component intensity level therebetween at 3 units. The switching sequence between time T1 and time T2 first involves repeated switching between the basic level of 5 units and the basic level of 3 units, gradually increasing the relative dwelling time at the lower level. The last half of the switching sequence involves repeated switching between the basic level of 3 units and the basic level of 1 units, again gradually increasing the relative dwelling time at the lower level.

How smooth will the perceived change be, depends on the switching frequency between the basic levels as well as the difference in intensity between adjacent basic levels. As a rule of thumb, if the switching between two adjacent basic levels occurs at a fixed switching period with only the duty cycle changing, the length of the switching period should be less than one tenth of the integration period of the integrating detection means. The concept of switching period means the time interval during which the basic lighting controller dwells in one state and immediately thereafter in another state, if the switching sequence only involves switching between two adjacent basic levels at a time. It is not necessary to perform the switching with a fixed switching period; the length of a switching period may vary during a switching sequence. Also the length of a switching period may change between two different kinds of changes between desired constant intensity levels. If the switching sequence involves repeated switching between three or more basic levels, it may even become difficult to unambiguously determine a switching period.

Practical experiments with an arrangement according to the invention have suggested that when a LED light source is driven alternatively with an 18 mA current or a 3 mA current, the human eye begins to perceive flickering if consecutive brighter (18 mA) pulses occur at a frequency that is less then 120 Hz. Consequently the switching sequences should be designed so that the repetition frequency of brighter pulses is always higher than 120 Hz.

It should be noted that FIGS. 3 and 4 do not represent truly real cases, because implementing a change in as few steps as are illustrated here would not result in as smooth an integrated result as the smooth curves 302 and 402 would suggest. The drawings are merely schematic by nature, and the very small number of steps was selected to enhance graphical clarity.

FIGS. 3 and 4 both illustrate changes between two intensity levels that happen to belong to the limited set of basic or component levels (5, 3 or 1 units in FIGS. 3 and 4). It is clear that temporal multiplexing and integration can also be used to produce constant levels of lighting intensity. In a simplified example, if the lighting controller that was assumed to exist in the cases of FIGS. 3 and 4 was left constantly toggling e.g. at a 50% duty cycle between the basic levels of 5 and 3 units, the perceived (integrated) output level would equal 4 units.

Figure 5:
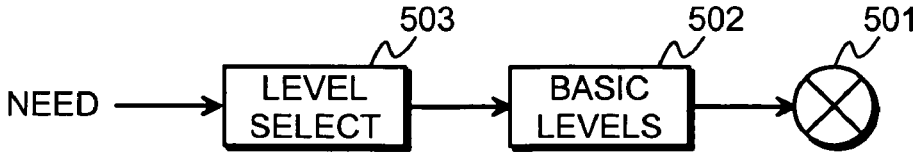
FIG. 5 illustrates a concept of having a level selector before a lighting controller.

FIG. 5 illustrates an implementation principle, according to which a light source (or arrangement of light sources) 501 receives its operating power from a basic lighting controller 502. The word "basic" indicates that the lighting controller 502 is only capable of producing a relatively limited number of output power levels, for example so that it is a PWM controller that only has some few possible output duty cycles, or it is a current controller that only has some few possible output current levels. A possible alternative connection is such where the light source 501 is separately coupled to an operating voltage source and includes a switch. If such a connection includes a simple on/off switch at each light source, the lighting controller 502 only supplies command pulses that set the switch either on or off at a certain duty cycle selected from a very limited set of possible output duty cycles. If said alternative connection involves an analog switch, the commands from the lighting controller set the analog switch into one of certain few possible states to allow a current of preselected magnitude to flow through the light source.

The lighting controller 502 is coupled to receive switching commands from level selecting means, conceptually represented as 503 in FIG. 5. The level selecting means 503 generate the switching sequences that represent changes between desired output levels or dwelling in a virtual level between two basic states. Obviously even the level selecting means 503 must receive from somewhere the information about what is the currently desired level of lighting intensity; however, since generating such information and delivering it to the level selecting means are outside the scope of the present invention, that subject is not treated here in detail.

Figure 6:
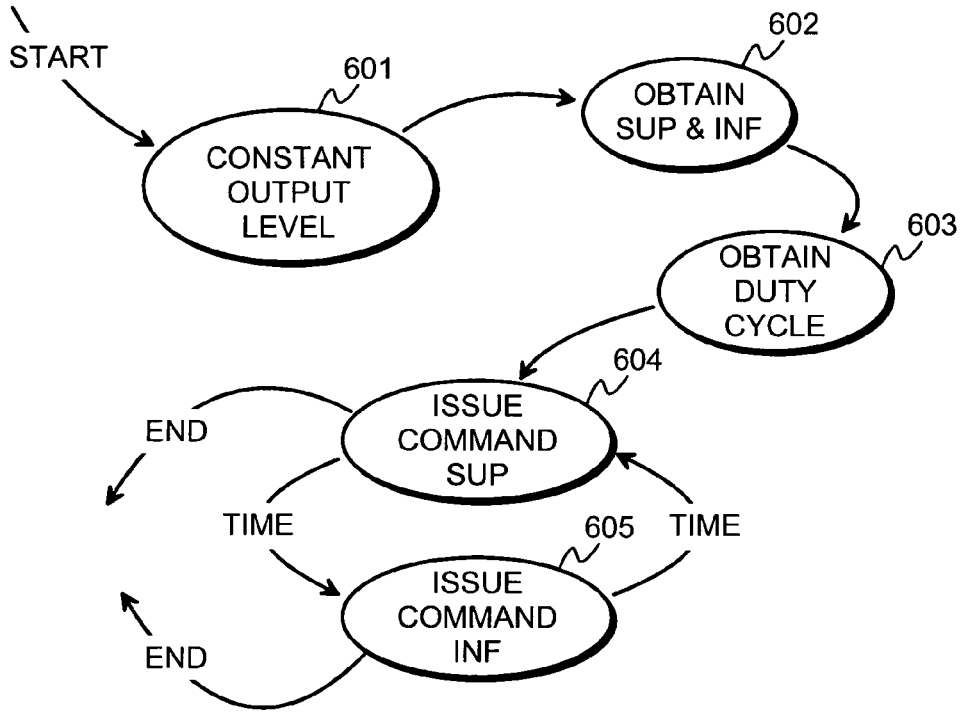
FIG. 6 illustrates a state diagram of a lighting control method.

We will next consider some alternative ways of implementing the level selecting means in practice. A first alternative is to implement the level selecting means as a software routine and to make a processor within the electronic device in question to execute such a software routine. Certain parts of the software routine must in such case cause the processor to issue a level selecting command to the lighting controller in a well-timed manner. FIG. 6 is a state diagram that schematically illustrates the operation of software-based level selecting means when constant lighting intensity is desired. A starting command of some kind causes the software routine to begin to be executed. According to state 601, it is first noticed that present operation concerns maintaining a constant lighting intensity at some predefined level, an indication of which level came to the software routine as a part of the starting command.

At state 602 the supremum and infimum levels are determined. A supremum level means the basic level that belongs to the limited basic output level set of the lighting controller and is as close as possible and equal to or higher than the intensity level now desired. Correspondingly an infimum level means the basic level that belongs to the limited basic output level set of the lighting controller and is as close as possible but equal to or lower than the intensity level now desired. If the desired level happens to match exactly one of the basic levels, state 602 means determining that basic level.

State 603 corresponds to determining the duty cycle at which switching between the supremum and infimum levels should occur in order to achieve the desired intensity level after integration. If there is a linear relationship between duty cycles and eventually obtained intensity levels, state 603 involves calculating the difference between the supremum and infimum levels as well as the difference between the desired level and the infimum level, and noting how many per cent the latter is of the former. This percentage will become the relative dwelling time on the supremum level, and the complementing percentage will become the relative dwelling time on the infimum level. If the relationship between duty cycles and eventually obtained intensity levels is nonlinear, such nonlinearity must be taken into account in determining the duty cycle. Typical implementations for obtaining duty cycles involve look-up tables, where the desired intensity level is mapped into a predefined duty cycle.

The duty cycle is stored in a form that can be later used as an indication of how long should the control algorithm allow the lighting controller to dwell at each state. At state 604 the lighting controller is told to go into a state corresponding to the supremum level. After the dwelling time in that level has been exhausted, there occurs a change into state 605 where the lighting controller is told to go to a state corresponding to the infimum level. A return to state 604 occurs when the dwelling time in the infimum state ends. The loop consisting of states 604 and 605 is circulated until some ending command causes the lighting control software routine to be aborted. If state 602 resulted in determining one of the basic levels, the duty cycle will be 100% and there will never occur any toggling between states 604 and 605. A command to the appropriate state is simply issued, and that command remains valid until the ending command.

Figure 7:
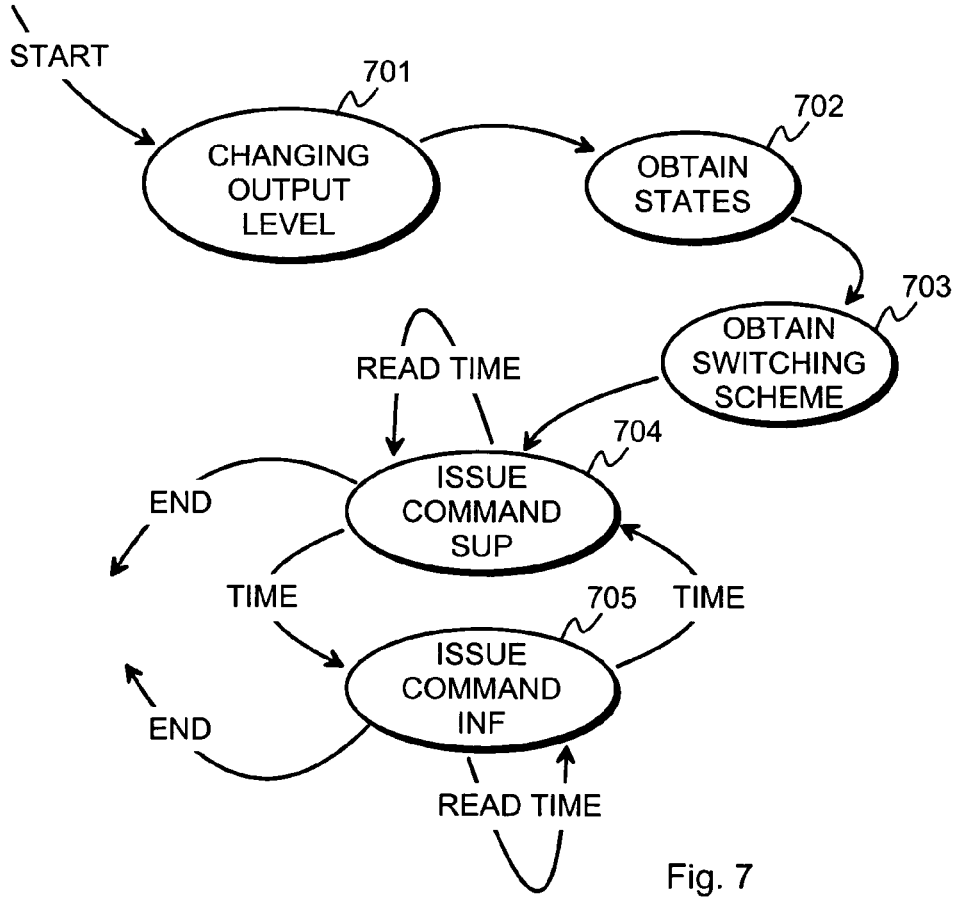
FIG. 7 illustrates another state diagram of a lighting control method.

FIG. 7 illustrates the operation of the software-based level selecting means when a smooth change in the lighting intensity is desired. A starting command again causes the software routine to begin to be executed. According to state 701, it is now noticed that present operation concerns a change from a first predefined level to a second predefined level. One or both of these levels may belong to the set of basic levels, but that is not necessary. At state 702 the basic levels that will be involved in the change are determined. For a decreasing change in intensity these are at least the supremum for the level at which decreasing the lighting intensity begins, and the infimum for the level at which decreasing the lighting intensity ends. Correspondingly for an increasing change in intensity these are at least the infimum for the level at which decreasing the lighting intensity begins, and the supremum for the level at which decreasing the lighting intensity ends. As was shown in FIG. 4, the change may involve other basic levels therebetween.

At state 703 the switching scheme for the change is obtained. How this is accomplished in detail will be discussed later. At state 704 there is issued the command to achieve the supremum of that level where the change begins. Also the time to be dwelled on that level is read from the schedule obtained at state 703. At the appropriate time a change to the currently valid infimum level at state 705 occurs. The algorithm toggles between states 704 and 705 according to the schedule obtained at state 703 until the desired target level of lighting intensity is reached or until some other ending condition causes the process to be aborted.

Figure 8:
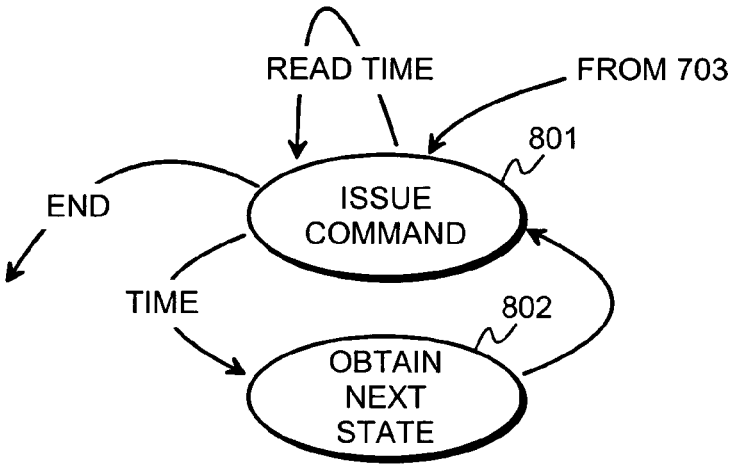
FIG. 8 illustrates an alternative detail to the state diagram of FIG. 7.

FIG. 8 is a generalisation to be used in place of states 704 and 705 of FIG. 7 if the change involves more than two levels. Each time in state 801 a command for going to the next level is obtained. After the dwelling time at that level has been exhausted, the new level is determined at state 802, so that return to state 801 now means going to the new level.

Figure 9:
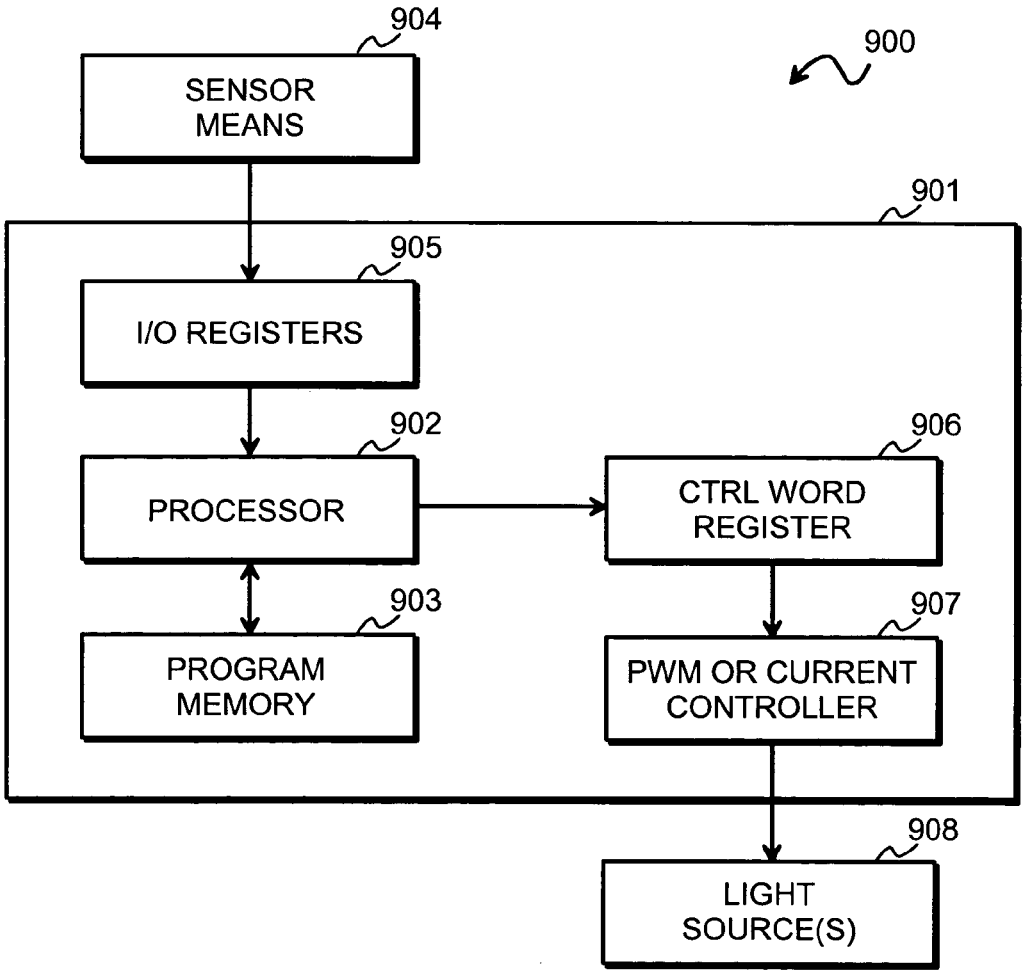
FIG. 9 illustrates an integrated circuit implementation of an embodiment of the invention.

FIG. 9 illustrates parts 900 of a portable electronic device that are involved in implementing a software control based embodiment of the invention, such as that described above in association with FIGS. 6-8. The portable electronic device comprises an integrated circuit 901, the executive core of which is a microprocessor 902. The microprocessor 902 is configured to execute programs stored in a program memory 903, which may constitute a part of the integrated circuit 901 as in FIG. 9 or exist in another component of the portable electronic device 900. In order to detect the need for certain lighting intensity at a user interface of the electronic device 900 the device comprises sensor means 904. These may include a sensor that is explicitly provided for measuring the amount of ambient light. Alternatively or additionally the sensor means 904 may exist as an additional functionality of a component that is primarily used for something else: for example the use of keys or the opening of a flip cover may be interpreted to signify the need for activating user interface lighting of a certain intensity level. As was described earlier in association with prior art, the sensor means 904 may also exist "conceptually" e.g. as a software routine that triggers the need for illuminating the user interface. In the exemplary embodiment of FIG. 9 we assume that the sensor means 904 exist externally to the integrated circuit 900, and that they are configured to indicate a detection result to the microprocessor 902 through a certain input register in an I/O register bank 905.

In this exemplary embodiment the pieces of software that constitute the control routines illustrated in FIGS. 6-8 exist as a part of program code stored in the program memory 903. The microprocessor 902 is configured to schedule certain time for repeatedly executing the control routines and to each time write the resulting level selecting commands to a control word register 906. A basic lighting controller 907 exists within the integrated circuit 900 and is configured to repeatedly read a control word from the register 906 and to output a lighting control signal that represents one of the relatively limited set of possible basic intensity levels the basic lighting controller 907 is capable of expressing. Said lighting control signal is typically a PWM pulse train or a current level, which is coupled to a light source or arrangement of light sources 908.

Figure 10:
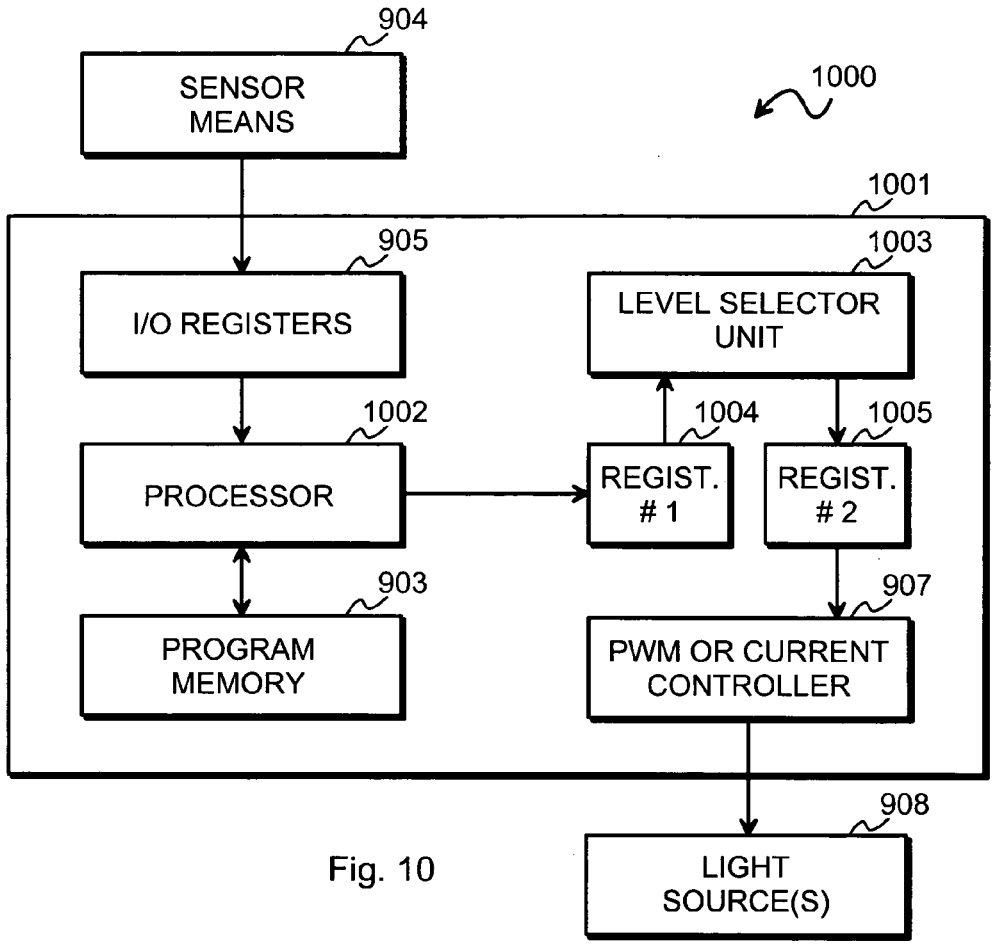
FIG. 10 illustrates an integrated circuit implementation of another embodiment of the invention.

FIG. 10 illustrates parts 1000 of a portable electronic device that is configured to implement an alternative embodiment of the invention. Also in FIG. 10 the portable electronic device comprises an integrated circuit 1001 with a microprocessor 1002 as its executive core, but according to this alternative embodiment the microprocessor 1002 is not directly responsible for issuing each and every level selection command to the basic lighting controller 907. The level selection commands are generated in a separate level selector unit 1003, which also exists within the integrated circuit 1001. A piece of control software, which is stored in the program memory 903 and configured to be executed by the microprocessor 1002, only causes the microprocessor 1002 to determine a target lighting intensity level, which the microprocessor indicates by writing a corresponding target intensity control word into a first register 1004. The level selector unit 1003 is configured to read the target intensity control word from the first register and to determine a switching sequence that represents a change from a previously used intensity level to the target intensity level and/or maintains the lighting intensity level at the target value.

The level selector unit 1003 is configured to reduce the switching sequence into practice by writing the corresponding basic level selection commands into a second register 1005 in a timely manner. Similarly as in the embodiment of FIG. 9, a basic lighting controller 907 is configured to repeatedly read a control word from the second register 1005 and to output a lighting control signal that represents one of the relatively limited set of possible basic intensity levels the basic lighting controller 907 is capable of expressing. The roles of the sensor means 904 and the light source(s) 908 are the same as in FIG. 9.

Figure 11:
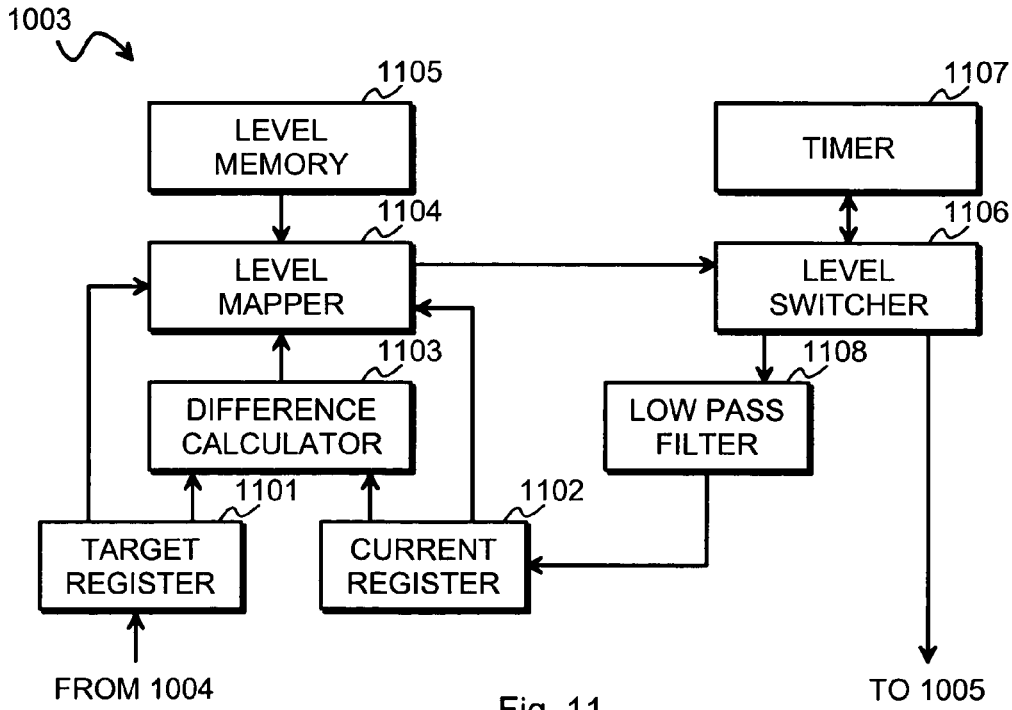
FIG. 11 illustrates a detail of the integrated circuit of FIG. 10.

FIG. 11 illustrates schematically an exemplary implementation of a level selector unit 1003. It comprises a target intensity register 1101 and a current intensity register 1102, which are configured to store code values or control words representing a target lighting intensity and a current lighting intensity respectively. A difference calculator 1103 is configured to calculate the difference between a target lighting intensity and the current lighting intensity, as represented by the respective code words stored in the registers 1101 and 1102. The calculated difference is taken into a level mapper 1104 together with the information about the target and current levels from registers 1101 and 1102. The task of the level mapper 1104 is to map the current situation concerning the target and the difference into a switching scheme, which aims at achieving the target intensity level according to some predefined rules. In determining the switching scheme the level mapper utilises information about the available basic levels taken from a level memory 1105.

The completed switching scheme is communicated from the level mapper 1104 into a level switcher 1106, typically in the form of a percentage and a pair of basic levels (example: 32 per cent of level A, the rest i.e. 78 per cent of level B). The level switcher 1106 utilises a timer 1107 to implement the switching scheme in practice, resulting in a well-timed sequence of a level selection commands or code words which are ready to be output to the register 1005. In order to keep also the level selector unit 1003 up to date about the current lighting intensity level, the level selection commands are also taken into a low pass filter 1108, which imitates the integrating functionality of the observer's visual system and thus produces an indication of the current perceivable lighting intensity. This indication is used as the contents of the current intensity register 1102.

Figure 12:
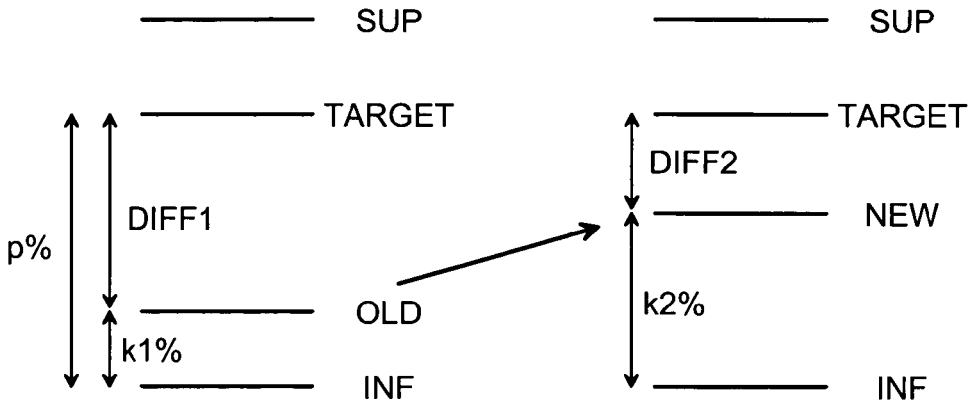
FIG. 12 illustrates an intermediate intensity level transition.

In the foregoing we have indicated how certain rules should be applied to determine a switching scheme either at state 703 of the software implementation of FIG. 7 or in the level mapper of 1104 of the implementation of FIG. 11. An example of such rules are given in the following. FIG. 12 illustrates how an old intensity level, which represents the current intensity level at the beginning of a change, and a target intensity level are both between certain supremum (SUP) and infimum (INF) levels. The last-mentioned belong to the relatively limited set of basic levels that a lighting controller is capable of expressing. To implement a gradual change, there should first occur a change from the old intensity level to a new intensity level that is closer to the target level but not immediately the same. We assume that the target level resides at p % of the difference between the SUP and INF levels, the old intensity level is at k1%, and the new intensity level should be at k2% of the difference between the SUP and INF levels. It is easy to show that in terms of temporal multiplexing, the target, old and new intensity levels are:

$$\text{TARGET}=p\,\%\cdot SUP+(100-p)\%\cdot INF$$

$$\text{OLD}=k1\%\cdot SUP+(100-k1)\%\cdot INF$$

$$\text{NEW}=k2\%\cdot SUP+(100-k2)\%\cdot INF$$

In other words, if e.g. a temporally multiplexed combination consists of a SUP level intensity for p% of the time and INF level intensity for the rest of the time, the perceived intensity level is the TARGET level. The difference DIFF1 between the target and old levels is (p−k1)% and the difference DIFF2 between the target and new levels is (p−k2)%.

We may now define a rule, according to which DIFF2 must be a certain fraction of DIFF1. For example the difference must be halved, i.e. DIFF2 is one half of DIFF1. A simple manipulation gives $$\text{NEW}=\tfrac{1}{2}(p+k1)\%\cdot SUP+(100-\tfrac{1}{2}(p+k1))\%\cdot INF$$

So when there are known the proportionality factors p and k1 that represent how the old and the target intensity values are obtained from the SUP and INF values, a simple calculation gives the proportionality factor k2 that tells, what should the relative amounts of SUP and INF intensities be in the next newer temporally multiplexed switching scheme. It is easy to show how the conclusions shown above are valid also in a decreasing intensity situation, where the target intensity is lower than the current intensity, if only the SUP and INF values are selected so that SUP is the supremum for the current intensity and INF is the infimum of the target intensity.

Requiring DIFF2 to be one half of DIFF1 is just one example. Many other kinds of alternative linear and nonlinear requirements could be used, with straightforward consequences in the manipulation that gives the correct percentage expression to the new intensity level.

Figure 13:
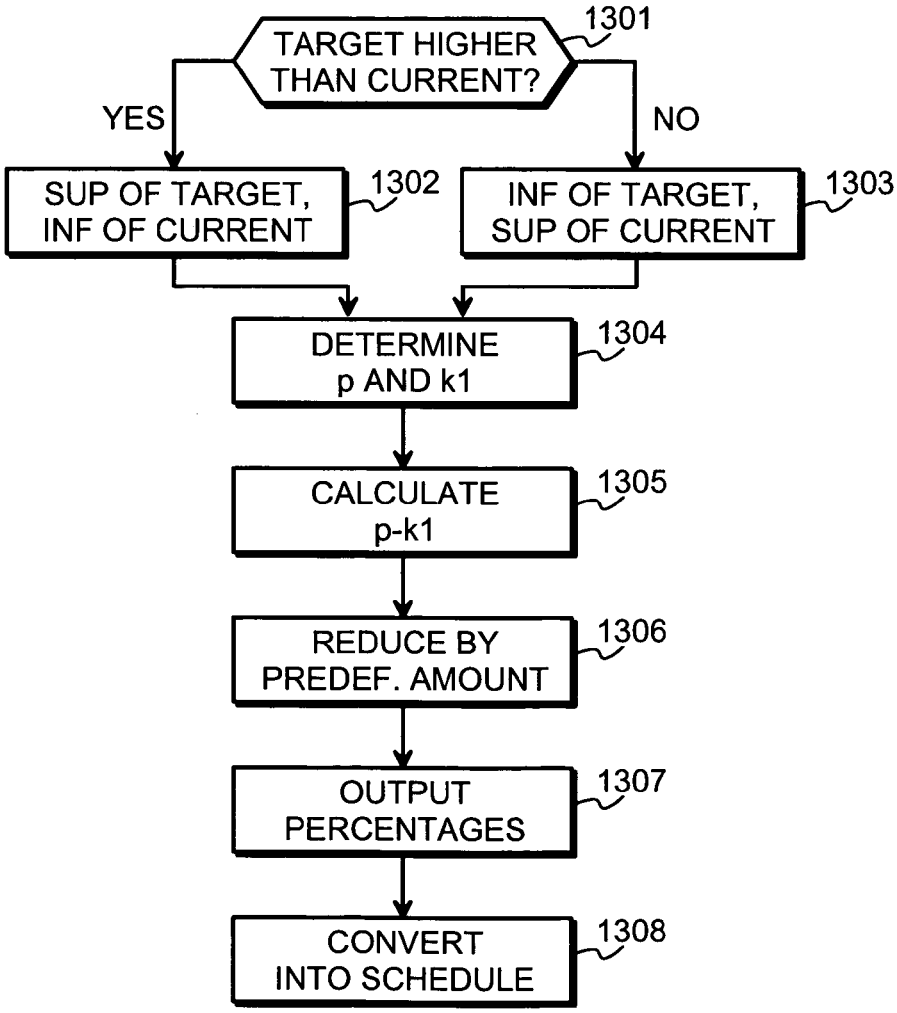
FIG. 13 illustrates the determination of a switching scheme.

FIG. 13 illustrates schematically the process of determining a switching scheme in a changing intensity situation. At step 1301 it is preliminarily examined, whether the target level is higher or lower than the current level. Depending on the result, the SUP and INF levels are selected appropriately at either step 1302 or step 1303. At step 1304 the target and current intensities are compared to the selected SUP and INF levels in order to determine the proportionality factors p and k1. At step 1305 the difference p−k1 is calculated. Step 1306 corresponds to using the p, k1 and p−k1 values for calculating the k2 value; the term "reduce" at step 1306 means that the difference between the new current intensity and the target intensity is thus reduced from what it was with the old current intensity. At step 1307 the switching scheme is output in a form that indicates, how many per cent there should be of the SUP level and how many per cent of the INF value in the temporal multiplexing sequence. At step 1308 the percentages are converted into actual time values: for example if a switching period is 100 microseconds, the percentages give directly the dwelling time lengths in microseconds.

In the more hardware-oriented embodiments of the invention, an example of which is illustrated in FIGS. 10 and 11, it is possible to implement the decision routine according to FIG. 13 in an array of logic gates and other digital circuit elements. The practical implementation of such a digital circuit is straightforward to the person skilled in the art after having been given the description of how the circuit should operate.

How fast the changing intensity level will converge towards the target intensity level depends on certain time considerations related to the process of determining a switching scheme. In software-based embodiments like that represented in FIGS. 7 and 8 it is possible to calculate (or to read from a look-up memory) a whole switching scheme up to the point of achieving the target intensity. Such a calculation (or the calculation on the basis of which the look-up memory was programmed) can naturally be made to take into account any arbitrarily selected timing factors. In embodiments like that illustrated in FIGS. 10 and 11 the timing of convergence depends on the characteristics of the low pass filter 1108: the faster the changes acre reflected in the value of the current intensity register 1102, which value includes the smoothing effect of the low pass filter 1108, the faster the process will converge. Suitable timings for each type of embodiments may be found through experimenting.

Figure 14:
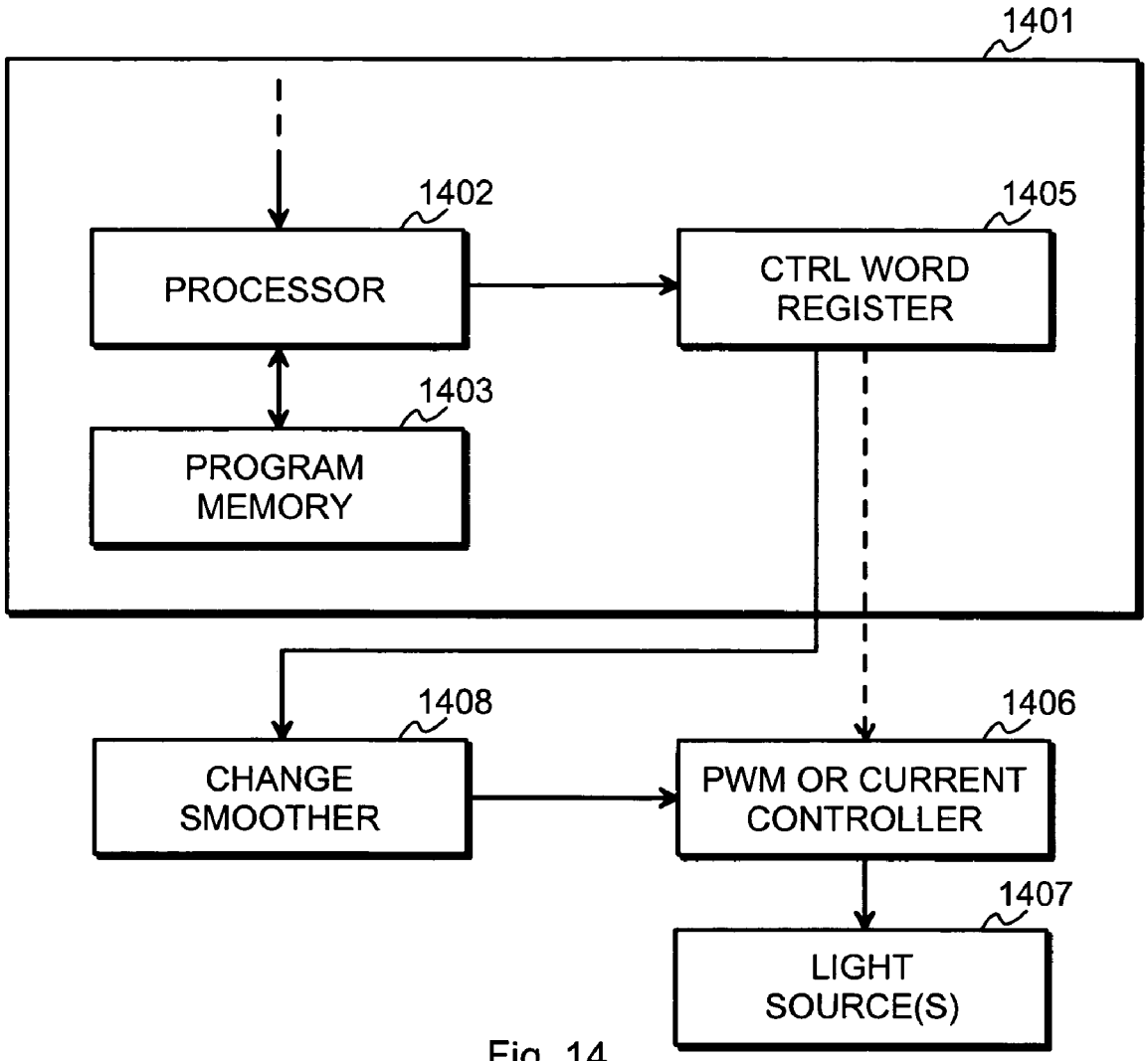
FIG. 14 illustrates a circuit implementation of yet another embodiment of the invention.

In the foregoing we have mainly described the application of the invention as a part of an integrated circuit that also includes a controlling microprocessor and even the basic lighting intensity controller the limited output capabilities of which constitute a motivation for applying the present invention. However, the invention is applicable also in other kinds of circuit architectures. FIG. 14 illustrates how an integrated circuit 1401 comprises a microprocessor 1402 which, executing a control program stored in a program memory 1403, produces a lighting intensity command or codeword and writes it into a register 1405 that actually is an output register of the integrated circuit 1401. In a prior art solution the codeword would have gone directly from the register 1405 into a basic lighting controller 1406 and would have had to belong to the relatively limited set of codewords that matched the limited output capabilities of the basic lighting controller 1406, which controlled light source(s) 1407. The prior art connection is shown as a dashed line in FIG. 14.

In accordance with the present invention such a prior art arrangement can be augmented by placing, between the output register 1405 of the integrated circuit and the basic lighting controller 1406, an additional circuit element 1408. If the microprocessor 1402 were not reprogrammed to take the existence of the additional circuit element 1408 into account, it would only issue codewords from said limited set as if the arrangement still were functioning as a prior art circuit. Even in such a case the additional circuit element 1408 could react to all changes in codewords, by not letting the changes propagate directly to the basic lighting controller 1406 but smoothing the change by making the basic lighting controller 1406 execute a switching sequence like that illustrated in FIGS. 3 and 4 in association with each change. The arrangement could exhibit further utility if, in addition to adding the additional circuit element 1408, the microprocessor 1402 would be reprogrammed so that it be also allowed to issue codewords that signify intermediate intensity levels between the basic levels.

At least theoretically it would be possible to utilize the invention even to enhance the operation of a prior art all-in-one integrated circuit, where the basic lighting controller were integrated together with the other circuit elements and the driving signal for the light source(s) only came out of such an integrated circuit. An additional circuit element could be placed between the integrated circuit and the light source(s), which additional circuit element would react to abrupt changes in the light source driving signal by smoothing it according to what has been described earlier.

In the foregoing description it has been assumed that a lighting control arrangement according to the invention would be used for providing smooth changes between otherwise relatively coarsely spaced basic intensity levels. However, it is perfectly possible to utilize the invention only for enabling the generation of intermediate intensity levels, still allowing the changes between intensity levels to be instantaneous. Such an embodiment of the invention is easily derived from those described above by simply omitting all references to smooth changes, and/or by requiring that in a change like that illustrated in FIG. 12 the equation k2=p always holds, with the appropriate consequences in the calculation formulas.

What is claimed is:

1. A lighting control arrangement for controlling user interface lighting in a portable electronic device, comprising:

an output configured to selectively provide lighting intensity commands to a lighting controller, at least two of which lighting intensity commands indicates certain non-zero basic lighting intensity levels and a level selector configured to repeatedly toggle, at a frequency that is higher than an integration frequency of a human visual system, between two such lighting intensity commands to be provided at said output that indicate non-zero basic lighting intensity levels.

2. A lighting control arrangement according to claim 1, wherein said level selector comprises a microprocessor configured to execute a lighting controller control program.

3. A lighting control arrangement according to claim 2, wherein in said lighting controller control program the microprocessor is instructed to maintain a constant lighting intensity by determining a higher basic lighting intensity level nearest to said constant lighting intensity and a lower basic lighting intensity level nearest to said constant lighting intensity; by determining a switching scheme that indicates constantly repeated switching between said nearest higher basic lighting intensity level and said nearest lower basic lighting intensity level; and by repeatedly issuing to a lighting controller lighting intensity commands that correspond to switching between said nearest higher basic lighting intensity level and said nearest lower basic lighting intensity level according to said switching scheme.

4. A lighting control arrangement according to claim 2, wherein in said lighting controller control program the microprocessor is instructed to implement a change from a lower lighting intensity to a higher lighting intensity by determining a lower basic lighting intensity level nearest to said lower lighting intensity and a higher basic lighting intensity level nearest to said higher lighting intensity; by determining a switching scheme that indicates repeated switching between said nearest higher basic lighting intensity level and said nearest lower basic lighting intensity level so that a relative dwelling time at said nearest higher basic lighting intensity level increases and a relative dwelling time at said nearest lower basic lighting intensity level decreases towards the end of said switching scheme; and by repeatedly issuing to a lighting controller lighting intensity commands that correspond to switching between said nearest higher basic lighting intensity level and said nearest lower basic lighting intensity level according to said switching scheme.

5. A lighting control arrangement according to claim 2, wherein in said lighting controller control program the microprocessor is instructed to implement a change from a lower lighting intensity to a higher lighting intensity by determining a lower basic lighting intensity level nearest to said lower lighting intensity, a higher basic lighting intensity level nearest to said higher lighting intensity, and at least one intermediate basic lighting intensity level between said lower lighting intensity and said higher lighting intensity; by determining a switching scheme that at a beginning indicates repeated switching between said nearest lower basic lighting intensity level and an intermediate basic lighting intensity level so that a relative dwelling time at said intermediate basic lighting intensity level increases and a relative dwelling time at said nearest lower basic lighting intensity level decreases, and at an end indicates repeated switching between said nearest higher basic lighting intensity level and an intermediate basic lighting intensity level so that a relative dwelling time at said intermediate basic lighting intensity level decreases and a relative dwelling time at said nearest higher basic lighting intensity level increases; and by repeatedly issuing to a lighting controller lighting intensity commands that correspond to switching between said basic lighting intensity levels according to said switching scheme.

6. A lighting control arrangement according to claim 2, wherein in said lighting controller control program the microprocessor is instructed to implement a change from a higher lighting intensity to a lower lighting intensity by determining a lower basic lighting intensity level nearest to said lower lighting intensity and a higher basic lighting intensity level nearest to said higher lighting intensity; by determining a switching scheme that indicates repeated switching between said nearest higher basic lighting intensity level and said nearest lower basic lighting intensity level so that a relative dwelling time at said nearest higher basic lighting intensity level decreases and a relative dwelling time at said nearest lower basic lighting intensity level increases towards the end of said switching scheme; and by repeatedly issuing to a lighting controller lighting intensity commands that correspond to switching between said nearest higher basic lighting intensity level and said nearest lower basic lighting intensity level according to said switching scheme.

7. A lighting control arrangement according to claim 2, wherein in said lighting controller control program the microprocessor is instructed to implement a change from a higher lighting intensity to a lower lighting intensity by determining a lower basic lighting intensity level nearest to said lower lighting intensity, a higher basic lighting intensity level nearest to said higher lighting intensity, and at least one intermediate basic lighting intensity level between said lower lighting intensity and said higher lighting intensity; by determining a switching scheme that at a beginning indicates repeated switching between said nearest higher basic lighting intensity level and an intermediate basic lighting intensity level so that a relative dwelling time at said intermediate basic lighting intensity level increases and a relative dwelling time at said nearest higher basic lighting intensity level decreases, and at an end indicates repeated switching between said nearest lower basic lighting intensity level and an intermediate basic lighting intensity level so that a relative dwelling time at said intermediate basic lighting intensity level decreases and a relative dwelling time at said nearest lower basic lighting intensity level increases; and by repeatedly issuing to a lighting controller lighting intensity commands that correspond to switching between said basic lighting intensity levels according to said switching scheme.

8. A lighting control arrangement according to claim 2, wherein in said lighting controller control program the microprocessor is instructed to respond to a detected need of changing lighting intensity by first determining a complete switching scheme for an entire of change of lighting intensity and by beginning executing a switching scheme only after said switching scheme has been completely determined.

9. A lighting control arrangement according to claim 2, wherein in said lighting controller control program the microprocessor is instructed to respond to a detected need of changing lighting intensity by beginning executing a switching scheme and by developing the switching scheme further during the execution of the switching scheme.

10. A lighting control arrangement according to claim 1, wherein said level selector is configured to repeatedly change the lighting intensity command to be provided at said output at a frequency that is higher than 1 kHz.

11. A lighting control arrangement according to claim 1, wherein said level selector comprises a level selector unit configured to receive lighting control commands from a microprocessor.

12. A lighting control arrangement according to claim 11, wherein the level selector unit comprises:

a first register configured to store a target codeword received from a microprocessor and indicating a target lighting intensity, a second register configured to store a current codeword indicating a currently perceivable lighting intensity, a difference calculator coupled to said first register and second register and configured to calculate a difference between an indicated target lighting intensity and an indicated currently perceivable lighting intensity, a level mapper coupled to said first register, said second register and said difference calculator and configured to map a combination of indicated target lighting intensity, indicated currently perceivable lighting intensity and calculated difference between indicated target and currently perceivable lighting intensities into a combination of at least two basic lighting intensity levels and relative dwelling times in said basic lighting intensity levels, a timer, a level switcher coupled to said level mapper and said timer and configured to produce timed level switching commands between basic lighting intensity levels, so that time intervals between level switching commands correspond to said relative dwelling times in said basic lighting intensity levels, and a low pass filter coupled to receive level switching commands from the level switcher, said low pass filter being configured to produce a low pass filtered result of consecutive level switching commands and to provide said low pass filtered result into said second register.

13. A lighting control system for controlling user interface lighting in a portable electronic device, comprising:

a lighting controller coupled to receive lighting intensity commands from a lighting control arrangement and to provide a lighting intensity signal to a light source, said lighting controller being configured to respond to at least two of a number of lighting intensity commands by producing a lighting intensity signal that corresponds to certain non-zero basic lighting intensity levels, a lighting control arrangement having an output coupled to said lighting controller, and as a part of said lighting control arrangement a level selector configured to repeatedly toggle, at a frequency that is higher than an integration frequency of a human visual system, between two such lighting intensity commands to be provided at said output that indicate non-zero basic lighting intensity levels.

14. A lighting control system according to claim 13, wherein said lighting control arrangement comprises a microprocessor configured to execute a lighting controller control program.

15. A lighting control system according to claim 14, comprising an integrated circuit, so that said microprocessor and said lighting controller both are located within said integrated circuit.

16. A lighting control system according to claim 14, comprising an integrated circuit, so that said microprocessor is located within said integrated circuit and said lighting controller is located in an auxiliary component external to said integrated circuit.

17. A lighting control system according to claim 14, wherein said microprocessor is configured to produce said lighting intensity commands and to deliver said lighting intensity commands to said lighting controller.

18. A lighting control system according to claim 14, comprising an integrated circuit and a level selector unit configured to receive lighting control commands from said microprocessor, so that said microprocessor, said level selector unit and said lighting controller are all located within said integrated circuit.

19. The lighting control system of claim 14, wherein in said lighting controller control program the microprocessor is instructed to maintain a constant lighting intensity by determining a higher basic lighting intensity level nearest to said constant lighting intensity and a lower basic lighting intensity level nearest to said constant lighting intensity; by determining a switching scheme that indicates constantly repeated switching between said nearest higher basic lighting intensity level and said nearest lower basic lighting intensity level; and by repeatedly issuing to a lighting controller lighting intensity commands that correspond to switching between said nearest higher basic lighting intensity level and said nearest lower basic lighting intensity level according to said switching scheme.

20. The lighting control system of claim 14, wherein in said lighting controller control program the microprocessor is instructed to implement a change from a lower lighting intensity to a higher lighting intensity by determining a lower basic lighting intensity level nearest to said lower lighting intensity and a higher basic lighting intensity level nearest to said higher lighting intensity; by determining a switching scheme that indicates repeated switching between said nearest higher basic lighting intensity level and said nearest lower basic lighting intensity level so that a relative dwelling time at said nearest higher basic lighting intensity level increases and a relative dwelling time at said nearest lower basic lighting intensity level decreases towards the end of said switching scheme; and by repeatedly issuing to a lighting controller lighting intensity commands that correspond to switching between said nearest higher basic lighting intensity level and said nearest lower basic lighting intensity level according to said switching scheme.

21. The lighting control system of claim 14, wherein in said lighting controller control program the microprocessor is instructed to implement a change from a lower lighting intensity to a higher lighting intensity by determining a lower basic lighting intensity level nearest to said lower lighting intensity, a higher basic lighting intensity level nearest to said higher lighting intensity, and at least one intermediate basic lighting intensity level between said lower lighting intensity and said higher lighting intensity; by determining a switching scheme that at a beginning indicates repeated switching between said nearest lower basic lighting intensity level and an intermediate basic lighting intensity level so that a relative dwelling time at said intermediate basic lighting intensity level increases and a relative dwelling time at said nearest lower basic lighting intensity level decreases, and at an end indicates repeated switching between said nearest higher basic lighting intensity level and an intermediate basic lighting intensity level so that a relative dwelling time at said intermediate basic lighting intensity level decreases and a relative dwelling time at said nearest higher basic lighting intensity level increases; and by repeatedly issuing to a lighting controller lighting intensity commands that correspond to switching between said basic lighting intensity levels according to said switching scheme.

22. The lighting control system of claim 14, wherein in said lighting controller control program the microprocessor is instructed to implement a change from a higher lighting intensity to a lower lighting intensity by determining a lower basic lighting intensity level nearest to said lower lighting intensity and a higher basic lighting intensity level nearest to said higher lighting intensity; by determining a switching scheme that indicates repeated switching between said nearest higher basic lighting intensity level and said nearest lower basic lighting intensity level so that a relative dwelling time at said nearest higher basic lighting intensity level decreases and a relative dwelling time at said nearest lower basic lighting intensity level increases towards the end of said switching scheme; and by repeatedly issuing to a lighting controller lighting intensity commands that correspond to switching between said nearest higher basic lighting intensity level and said nearest lower basic lighting intensity level according to said switching scheme.

23. The lighting control system of claim 14, wherein in said lighting controller control program the microprocessor is instructed to implement a change from a higher lighting intensity to a lower lighting intensity by determining a lower basic lighting intensity level nearest to said lower lighting intensity, a higher basic lighting intensity level nearest to said higher lighting intensity, and at least one intermediate basic lighting intensity level between said lower lighting intensity and said higher lighting intensity; by determining a switching scheme that at a beginning indicates repeated switching between said nearest higher basic lighting intensity level and an intermediate basic lighting intensity level so that a relative dwelling time at said intermediate basic lighting intensity level increases and a relative dwelling time at said nearest higher basic lighting intensity level decreases, and at an end indicates repeated switching between said nearest lower basic lighting intensity level and an intermediate basic lighting intensity level so that a relative dwelling time at said intermediate basic lighting intensity level decreases and a relative dwelling time at said nearest lower basic lighting intensity level increases; and by repeatedly issuing to a lighting controller lighting intensity commands that correspond to switching between said basic lighting intensity levels according to said switching scheme.

24. The lighting control system of claim 13, wherein said level selector comprises a level selector unit configured to receive lighting control commands from a microprocessor.

25. The lighting control system of claim 24, wherein the level selector unit comprises:

a first register configured to store a target codeword received from a microprocessor and indicating a target lighting intensity, a second register configured to store a current codeword indicating a currently perceivable lighting intensity, a difference calculator coupled to said first register and second register and configured to calculate a difference between an indicated target lighting intensity and an indicated currently perceivable lighting intensity, a level mapper coupled to said first register, said second register and said difference calculator and configured to map a combination of indicated target lighting intensity, indicated currently perceivable lighting intensity and calculated difference between indicated target and currently perceivable lighting intensities into a combination of at least two basic lighting intensity levels and relative dwelling times in said basic lighting intensity levels, a timer, a level switcher coupled to said level mapper and said timer and configured to produce timed level switching commands between basic lighting intensity levels, so that time intervals between level switching commands correspond to said relative dwelling times in said basic lighting intensity levels, and a low pass filter coupled to receive level switching commands from the level switcher, said low pass filter being configured to produce a low pass filtered result of consecutive level switching commands and to provide said low pass filtered result into said second register.

26. A portable electronic device, comprising:

a user interface, at least one controllable light source configured to provide controlled lighting to said user interface, a lighting controller coupled to receive lighting intensity commands from a lighting control arrangement and to provide a lighting intensity signal to said at least one controllable light source, said lighting controller being configured to respond to at least two lighting intensity commands by producing a lighting intensity signal that corresponds to certain non-zero basic lighting intensity levels, a lighting control arrangement having an output coupled to said lighting controller, and as a part of said lighting control arrangement a level selector configured to repeatedly toggle, at a frequency that is higher than an integration frequency of a human visual system, between two such lighting intensity command to be provided at said output that indicate non-zero basic lighting intensity levels.

27. A method for controlling user interface lighting in a portable electronic device, comprising the steps of:

producing a sequence of lighting intensity commands, each of which is a command for a lighting controller to produce one of certain basic lighting intensity levels, at least two of said basic lighting intensity levels representing non-zero lighting intensity, providing said lighting intensity commands to a lighting controller at a frequency that is higher than an integration frequency of a human visual system, and toggling, at a frequency that is higher than an integration frequency of a human visual system, between two such lighting intensity commands to be produced that indicate non-zero basic lighting intensity levels.

28. A method according to claim 27, comprising, in order to maintain a constant lighting intensity, the steps of:

determining a higher basic lighting intensity level nearest to said constant lighting intensity and a lower basic lighting intensity level nearest to said constant lighting intensity;

determining a switching scheme that indicates constantly repeated switching between said nearest higher basic lighting intensity level and said nearest lower basic lighting intensity level; and repeatedly issuing to a lighting controller lighting intensity commands that correspond to switching between said nearest higher basic lighting intensity level and said nearest lower basic lighting intensity level according to said switching scheme.

29. A method according to claim 27, comprising, in order to implement a change from a lower lighting intensity to a higher lighting intensity, the steps of:

determining a lower basic lighting intensity level nearest to said lower lighting intensity and a higher basic lighting intensity level nearest to said higher lighting intensity;

determining a switching scheme that indicates repeated switching between said nearest higher basic lighting intensity level and said nearest lower basic lighting intensity level so that a relative dwelling time at said nearest higher basic lighting intensity level increases and a relative dwelling time at said nearest lower basic lighting intensity level decreases towards the end of said switching scheme; and repeatedly issuing to a lighting controller lighting intensity commands that correspond to switching between said nearest higher basic lighting intensity level and said nearest lower basic lighting intensity level according to said switching scheme.

30. A method according to claim 27, comprising, in order to implement a change from a lower lighting intensity to a higher lighting intensity, the steps of:

determining a lower basic lighting intensity level nearest to said lower lighting intensity, a higher basic lighting intensity level nearest to said higher lighting intensity, and at least one intermediate basic lighting intensity level between said lower lighting intensity and said higher lighting intensity;

determining a switching scheme that at a beginning indicates repeated switching between said nearest lower basic lighting intensity level and an intermediate basic lighting intensity level so that a relative dwelling time at said intermediate basic lighting intensity level increases and a relative dwelling time at said nearest lower basic lighting intensity level decreases, and at an end indicates repeated switching between said nearest higher basic lighting intensity level and an intermediate basic lighting intensity level so that a relative dwelling time at said intermediate basic lighting intensity level decreases and a relative dwelling time at said nearest higher basic lighting intensity level increases; and repeatedly issuing to a lighting controller lighting intensity commands that correspond to switching between said basic lighting intensity levels according to said switching scheme.

31. A method according to claim 27, comprising, in order to implement a change from a higher lighting intensity to a lower lighting intensity, the steps of:

determining a lower basic lighting intensity level nearest to said lower lighting intensity and a higher basic lighting intensity level nearest to said higher lighting intensity;

determining a switching scheme that indicates repeated switching between said nearest higher basic lighting intensity level and said nearest lower basic lighting intensity level so that a relative dwelling time at said nearest higher basic lighting intensity level decreases and a relative dwelling time at said nearest lower basic lighting intensity level increases towards the end of said switching scheme; and repeatedly issuing to a lighting controller lighting intensity commands that correspond to switching between said nearest higher basic lighting intensity level and said nearest lower basic lighting intensity level according to said switching scheme.

32. A method according to claim 27, comprising, in order to implement a change from a higher lighting intensity to a lower lighting intensity, the steps of:

determining a lower basic lighting intensity level nearest to said lower lighting intensity, a higher basic lighting intensity level nearest to said higher lighting intensity, and at least one intermediate basic lighting intensity level between said lower lighting intensity and said higher lighting intensity;

determining a switching scheme that at a beginning indicates repeated switching between said nearest higher basic lighting intensity level and an intermediate basic lighting intensity level so that a relative dwelling time at said intermediate basic lighting intensity level increases and a relative dwelling time at said nearest higher basic lighting intensity level decreases, and at an end indicates repeated switching between said nearest lower basic lighting intensity level and an intermediate basic lighting intensity level so that a relative dwelling time at said intermediate basic lighting intensity level decreases and a relative dwelling time at said nearest lower basic lighting intensity level increases; and repeatedly issuing to a lighting controller lighting intensity commands that correspond to switching between said basic lighting intensity levels according to said switching scheme.

33. A computer program memory having a computer program stored thereon for execution by a processor in controlling user interface lighting in a portable electronic device, said computer program configured to:

produce a sequence of lighting intensity commands, each of which is a command for a lighting controller to produce one of certain basic lighting intensity levels, at least two of said basic lighting intensity levels representing non-zero lighting intensity, provide said lighting intensity commands to the lighting controller at a frequency that is higher than an integration frequency of a human visual system, and toggle, at a frequency that is higher than an integration frequency of a human visual system, between two such lighting intensity commands to be provided to the lighting controller that indicate non-zero basic lighting intensity levels.

34. An apparatus, comprising:

an output configured to selectively provide lighting intensity commands to a lighting controller, at least two of which lighting intensity commands indicates certain basic lighting intensity levels, and a level selector configured to repeatedly toggle, at a frequency that is higher than an integration frequency of a human visual system, between two such lighting intensity commands to be provided at said output that indicate non-zero basic lighting intensity levels.

35. An apparatus comprising:

a lighting controller coupled to receive lighting intensity commands from a lighting control arrangement and to provide a lighting intensity signal to a light source, said lighting controller being configured to respond to at least two of a number of lighting intensity commands by producing a lighting intensity signal that corresponds to certain non-zero basic lighting intensity levels, a lighting control arrangement having an output coupled to said lighting controller, and as a part of said lighting control arrangement a level selector configured to repeatedly toggle, at a frequency that is higher than an integration frequency of a human visual system, between two such lighting intensity commands to be provided at said output that indicate non-zero basic lighting intensity levels.

36. A method, comprising:

producing a sequence of lighting intensity commands, each of which is a command for a lighting controller to produce one of certain basic lighting intensity levels, at least two of said basic lighting intensity levels representing non-zero lighting intensity, providing said lighting intensity commands to a lighting controller at a frequency that is higher than an integration frequency of a human visual system, and toggling, at a frequency that is higher than an integration frequency of a himan visual system, between two such lighting intensity commands to be produced that indicate non-zero basic lighting intensity levels.

37. A computer readable medium, comprising:

software stored thereon which, when executed on a processor, is configured to make said processor produce a sequence of lighting intensity commands, each of which is a command for a lighting controller to produce one of certain basic lighting intensity levels, at least two of said basic lighting intensity levels representing non-zero lighting intensity, and provide said lighting intensity commands to a lighting controller at a frequency that is higher than an integration frequency of a human visual system toggle, at a frequency that is higher than an integration frequency of a human visual system, between two such lighting intensity commands to be provided to the lighting controller that indicate non-zero basic lighting intensity levels.

* * * * *

UNITED STATES PATENT AND TRADEMARK OFFICE

CERTIFICATE OF CORRECTION

PATENT NO. : 7,535,443 B2
APPLICATION NO. : 10/745467
DATED : May 19, 2009
INVENTOR(S) : Timo T. Lindqvist It is certified that error appears in the above-identified patent and that said Letters Patent is hereby corrected as shown below:

On the Title Page Item (56), "6,016,038 A 1/2000 Mueller et al." should be --6,016,038 A 12/2003 Mueller et al.--.

In column 20, line 27, which is claim 36, line 11 "himan" should be --human--.

Signed and Sealed this

Fifteenth Day of September, 2009

David J. Kappos

David J. Kappos
*Director of the United States Patent and Trademark Office*